US005416565A

United States Patent [19]

Noda

[11] Patent Number: 5,416,565

[45] Date of Patent: May 16, 1995

[54] METHOD AND APPARATUS FOR FORMING ELECTROPHOTOGRAPHIC IMAGE

[75] Inventor: Nobutaka Noda, Yokohama, Japan

[73] Assignee: Katsuragawa Electric Co., Ltd., Tokyo, Japan

[21] Appl. No.: 764,506

[22] Filed: Sep. 20, 1991

[30] Foreign Application Priority Data

| | | | |
|---|---|---|---|
| Sep. 21, 1990 | [JP] | Japan | 2-253804 |
| Sep. 21, 1990 | [JP] | Japan | 2-253807 |
| Dec. 12, 1990 | [JP] | Japan | 2-410471 |
| Dec. 12, 1990 | [JP] | Japan | 2-410472 |

[51] Int. Cl.[6] ..... G03G 15/02

[52] U.S. Cl. ..... 355/219; 355/246; 355/277; 355/296; 430/902

[58] Field of Search ..... 355/219, 271, 273, 276, 355/265, 246, 217, 296, 303, 274; 430/902, 31, 124–126; 361/212, 221, 225

[56] References Cited

U.S. PATENT DOCUMENTS

| | | | |
|---|---|---|---|
| 3,879,120 | 4/1975 | Kurokawa et al. | 355/274 |
| 3,879,196 | 4/1975 | Nagashima et al. | 430/126 X |
| 4,506,975 | 3/1985 | Shukuri et al. | 355/303 |
| 4,607,937 | 8/1986 | Minami | 361/225 X |
| 4,959,688 | 9/1990 | Koitabashi | 355/219 |
| 4,984,022 | 1/1991 | Matsushita et al. | 355/246 |
| 4,994,855 | 2/1991 | Ohashi et al. | 355/219 X |
| 5,017,965 | 5/1991 | Hashimoto et al. | 355/219 |
| 5,184,180 | 2/1993 | Choi | 355/219 |
| 5,253,017 | 10/1993 | Takeda | 355/219 |

FOREIGN PATENT DOCUMENTS 60-241068 11/1985 Japan .

*Primary Examiner*—A. T. Grimley
*Assistant Examiner*—Shuk Y. Lee
*Attorney, Agent, or Firm*—Venable, Baetjer, Howard & Civiletti

[57] ABSTRACT

A method and an apparatus for forming an electrophotographic image based on applying an AC voltage or a voltage obtained by superposing a DC voltage on an AC voltage to an electroconductive base of a sensitive medium having a photoconductive layer formed on the electroconductive base, bringing a grounded electroconductive or semi-electroconductive member into contact with or close to the surface of the sensitive medium to charge this surface to a predetermined polarity, and exposing the surface of the sensitive medium to an image to form an electrostatic image.

23 Claims, 10 Drawing Sheets

METHOD AND APPARATUS FOR FORMING ELECTROPHOTOGRAPHIC IMAGE

BACKGROUND OF THE INVENTION

This invention relates to a method and an apparatus for forming an image by utilizing electrophotography and, more particularly, to a method and an apparatus for forming an electrophotographic image without using corona discharge means.

A conventional image forming method using corona discharge means includes the steps of uniformly charging a surface of a sensitive medium by a corona discharge means to set a predetermined polarity, exposing the charged surface of the sensitive medium to a light image to selectively disperse the charges on the sensitive medium so that an electrostatic latent image is formed, supplying toner to the surface of the sensitive medium by a development sleeve to which a suitable bias is applied so that the electrostatic latent image formed on the sensitive medium is developed, and transferring the developed toner image on the sensitive medium onto a receptor sheet by using transfer corona discharge means.

This conventional method entails the problem of an offensive smell of ozone generated by corona discharge and the problem of a toxicity of ozone to the human body. This method also entails the problem of the quality of a formed copied image being easily influenced by environmental conditions, i.e., humidity, existence of dust, and other factors.

For the purpose of solving these problems, an image forming method has been proposed in which a charging roller or a transfer roller to which an external voltage is applied is used instead of corona discharge means.

In a known method of this kind, an electroconductive base of a sensitive medium is grounded, and a charging roller to which a DC bias voltage is applied is brought into contact with a surface of the sensitive medium to charge the surface of the sensitive medium. Then the surface of the sensitive medium is exposed to a light image of an original to be copied, and an electrostatic image corresponding to the original image is thereby formed on the sensitive medium. The electrostatic image is developed by toner carried by a development sleeve connected to a suitable bias supply. The developed toner image is transferred onto a receptor sheet such as a paper sheet by a transfer roller to which a transfer bias voltage is applied. The developing powder remaining on the surface of the sensitive medium after transfer is removed from the surface by a cleaning brush to which a suitable cleaning bias is applied.

This method can solve the above-mentioned problems of ozone. In this method, however, it is difficult to charge the sensitive medium surface uniformly and there is a potential problem of image unevenness or background fog of the resulting copied image.

For the purpose of solving this problem, a method of applying a pulsating voltage to the charging roller has been proposed as disclosed in Japanese Laid-Open Patent application No. 63-149668, for example.

This conventional method enables a reduction in charge unevenness on the sensitive medium surface but does not enable a reduction in the overall size of the apparatus. This method requires high-voltage power sources for units of image forming means, i.e., a power source for the charging roller, a power source for the development bias, a power source for the transfer roller and a power source for the cleaning bias. For this reason, if this method is used, it is difficult to provide a low-cost,compact image forming apparatus.

SUMMARY OF THE INVENTION

It is therefore an object of the present invention to provide a novel image forming method which minimizes the number of power sources for image forming means to reduce the size and the price of the apparatus.

Another object of the present invention is to provide an image forming method enabling to reproduce a clear image free from image unevenness and background fog, and an apparatus based on this method.

Still another object of the present invention is to provide an image forming apparatus using no corona discharge means and reduced in its size.

A further object of the present invention is to provide an image forming apparatus having a development means for providing a necessary development bias on a developer supply member without using an additional bias supply.

A still further object of the present invention is to provide a simple construction of a transfer member arranged to improve transfer efficiency without using an additional bias supply.

To achieve these and other objects, according to one aspect of the present invention, there is provided an image forming method comprising applying an alternating current voltage or a voltage obtained by superposing a direct current voltage on an alternating current voltage to an electroconductive base of a sensitive medium, bringing a grounded electroconductive or semi-electroconductive member into contact with or close to a surface of the sensitive medium to charge this surface to a predetermined polarity, and exposing the surface of the sensitive medium to a light image to form an electrostatic image.

As the grounded electroconductive or semi-electroconductive member is brought into contact with or close to the surface of the electroconductive base of the sensitive medium to which the bias voltage is applied, charges of the predetermined polarity are induced on the photoconductive layer surface of the sensitive medium in accordance with the bias voltage, thereby charging the sensitive medium surface. The surface of the sensitive medium is then exposed to a light image to form on the sensitive medium surface an electrostatic image corresponding to the exposure image.

According to another aspect of the present invention, a developer supplier for developing the electrostatic image is grounded directly or through an induced bias means, and charges are induced on the developer supplier by the bias voltage applied to the electroconductive base of the sensitive medium, thereby establishing a necessary development bias. The voltage of the development bias is set according to the rating value of the induced bias means connected to the developer supplier.

According to still another aspect of the invention, an alternating current voltage or a voltage obtained by superposing a direct current voltage on an alternating current voltage generally in phase with the voltage applied to the electroconductive base of the sensitive medium is applied to a transfer member. Specifically, this voltage applied to the transfer member is supplied from the power source for applying the bias voltage to the electroconductive base of the sensitive medium.

These and other objects, features and advantages of the present invention will become clear for those skilled in the art from the following description of preferred embodiments taken in conjunction with the accompanying drawings.

DESCRIPTION OF THE PREFERRED EMBODIMENTS

A method and an apparatus for forming images in accordance with the present invention will be described below with reference to the accompanying drawings.

Figure 1:
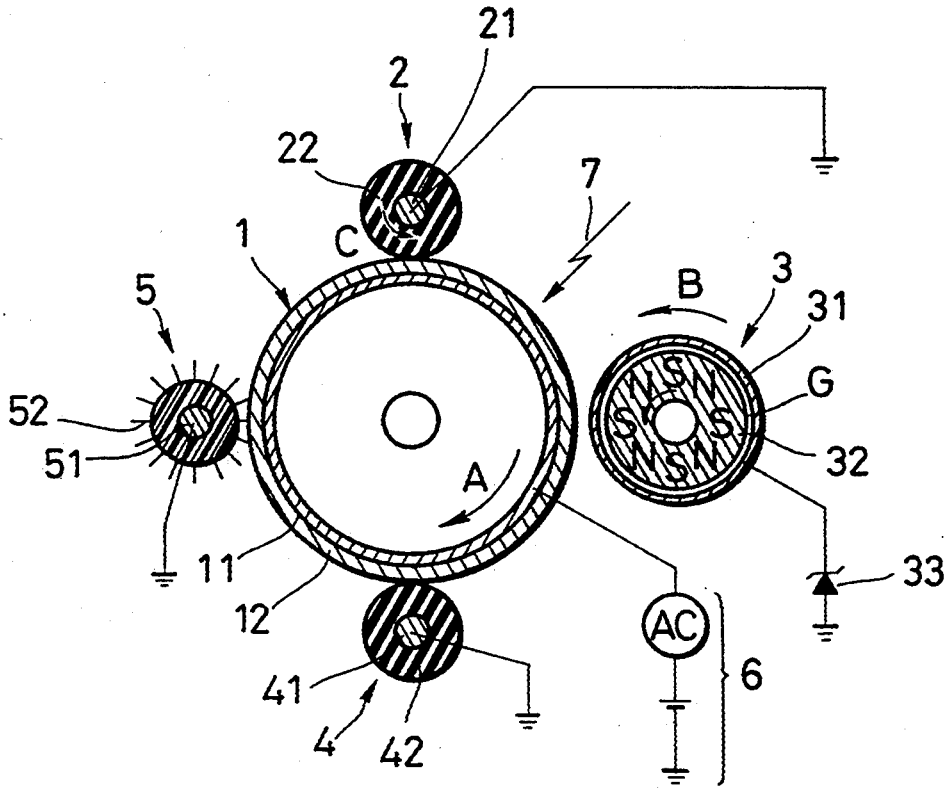
FIG. 1 is a schematic diagram of an example of an image forming apparatus in accordance with the present invention in which a voltage obtained by superposing a direct current on an alternating current is applied to an electroconductive base of a sensitive medium.

FIG. 1 shows an example of an image forming apparatus based on a method in accordance with the present invention. A sensitive medium 1 includes a drum-like electroconductive base (which may comprise a drum formed of an insulating material and an electroconductive layer formed on the drum) 11, and a photoconductive layer 12 formed on the surface of the base 11 by being deposited or applied thereto. As the material of the photoconductive layer 12, any of photoconductors of P- or N-type, e.g., OPC, Se, ZnO, CdS, and a-Si can suitably be used. An insulating layer may be formed on the photoconductive layer 12. The base 11 of the sensitive medium 1 is electrically connected to a bias supply 6. In this example, the bias supply 6 applies to the base 11 a voltage which is obtained by superposing a DC voltage on an AC voltage. The frequency of the AC voltage is, preferably, in the range of 80 Hz to 30 kHz, more preferably, in the range of 150 Hz to 3 kHz. Preferably, the superposed DC voltage is positive with respect to an N-type photoconductor, or is negative with respect to P-type photoconductor. The bias 6 may be an AC voltage or DC voltage alone as described later, although a voltage obtained by superposing a DC voltage on an AC voltage enables uniform charging most preferably.

The sensitive medium 1 is connected to a suitable drive means and is rotated in the direction of arrow A during operation.

A member 2 is disposed in contact with or close to the surface of the sensitive medium 1. The member 2 has the shape of a roller and has a construction in which a layer 22 of an electroconductive elastic rubber material is formed on the circumferential surface of an electroconductive metallic core 21 rotatably supported. In the illustration, the member 2 is shown in a state of contacting the surface of the sensitive medium 1. Alternatively, the member 2 may be disposed close to the sensitive medium 1 so that a small air gap (preferably, 120 μm or less) is formed between the member 2 and the surface of the sensitive medium 1. In either case, i.e., in the contact or close position, the member 2 is preferably rotated in a direction (indicated by arrow C) corresponding to the direction of rotation of the sensitive medium 1 at the same peripheral speed as the sensitive medium 1. It has experimentally been found that if the member 2 is not rotated, charge unevenness occurs in some cases. The member 2 can be rotated by being connected an independent drive source or by receiving a torque of the sensitive medium 1 through a suitable drive transmission means such as a gear train.

Figure 5:
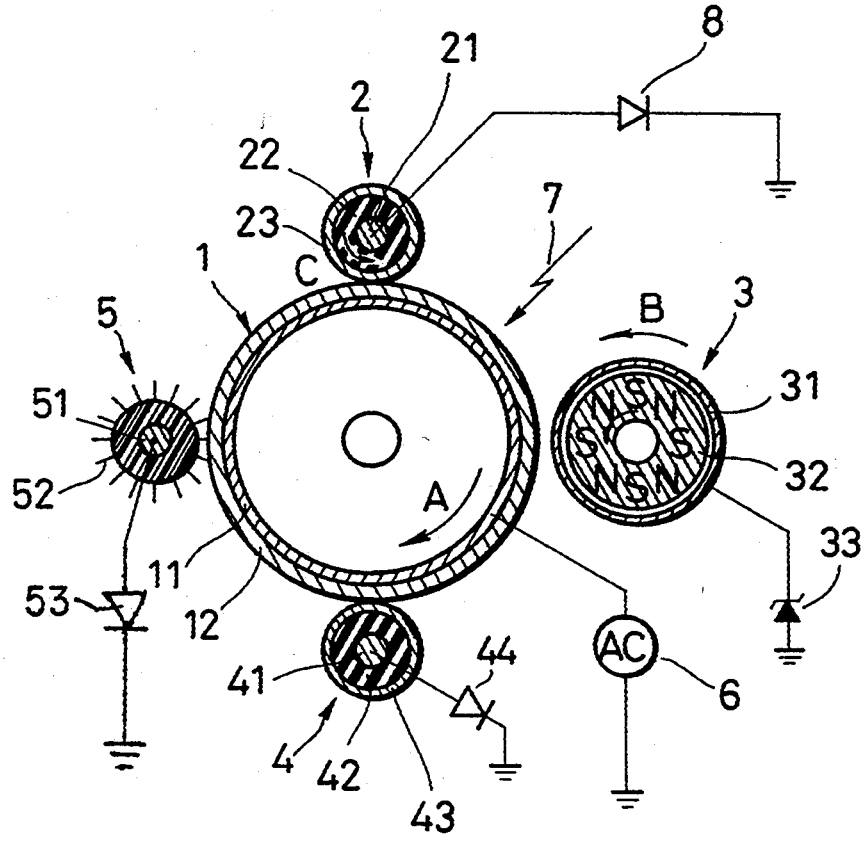
FIG. 5 is a schematic diagram of another example of the image forming apparatus in accordance with the present invention in which an alternating current voltage is applied to the electroconductive base of the sensitive medium.
Figure 10:
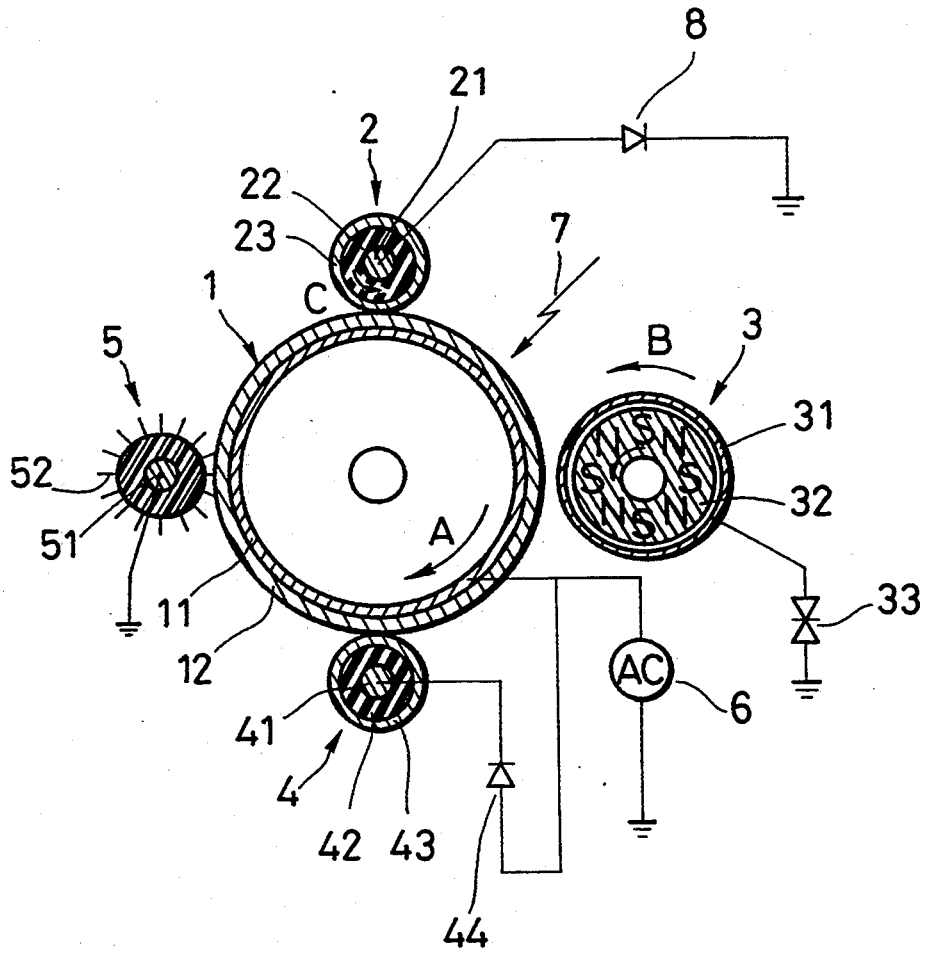
FIG. 10 is a schematic diagram of an arrangement in which an alternating current bias supply for the sensitive medium also serves as a bias supply for the transfer roller.

The layer 22 may be formed by dispersing an electroconductive powder in an elastic material such as nitrile rubber (NBR), urethane rubber or silicon rubber. A dielectric layer 23 formed of a synthetic resin such as a silicone resin or a polyethylene resin may be formed on the outer circumferential surface of the layer 22. (Examples of such a construction are illustrated in FIGS. 5 and 10). The layer 22 may be a semi-electroconductive material (having a resistivity of, for example, $10^5$ to $10^{10}$ Ωcm, for example) as well as an elastic electroconductive material (having a resistivity of, for example, smaller than $10^5$ Ωcm). The member 2 may alternatively be a rigid metallic member having no elastic layer. The core 21 is grounded directly or through a rectifier means 8 (FIG. 5) or induced bias means such as a varistor, a constant-voltage diode or an ordinary diode. To obtain a desired voltage on the surface of the sensitive medium, an arrangement such that the core 21 is grounded through a suitable resistor may suffice. The shape of the member 2 is, most preferably, such that a surface gradually spaced apart from the surface of the sensitive medium 1 is formed, as in the case of a roller. However, the member 2 may alternatively have the shape of a blade or a brush.

Figure 2:
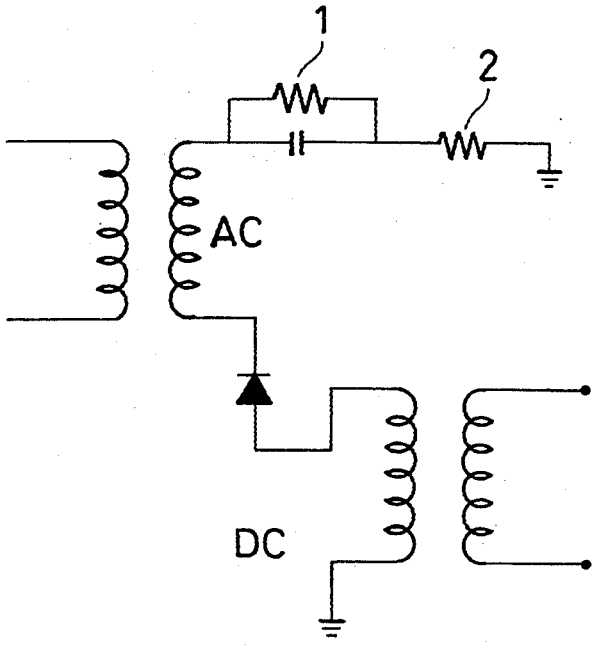
FIG. 2 is an equivalent circuit diagram relating to the sensitive medium and an induced member in accordance with the present invention.

FIG. 2 is an equivalent circuit diagram of a circuit for charging the surface of the sensitive medium 1. Under a dark condition, a predetermined bias voltage which is an AC voltage or a voltage obtained by superposing a DC voltage on an AC voltage is applied to the base 11 of the sensitive medium 1 by the power supply 6, and the member 2 is brought into contact with or close to the surface of the sensitive medium. Then the voltage is divided in accordance with the impedances of the sensitive medium 1, the member 2 and the air layer therebetween, and the charge in accordance with the corresponding divided value is induced on the surface of the sensitive medium 1.

Figure 3:
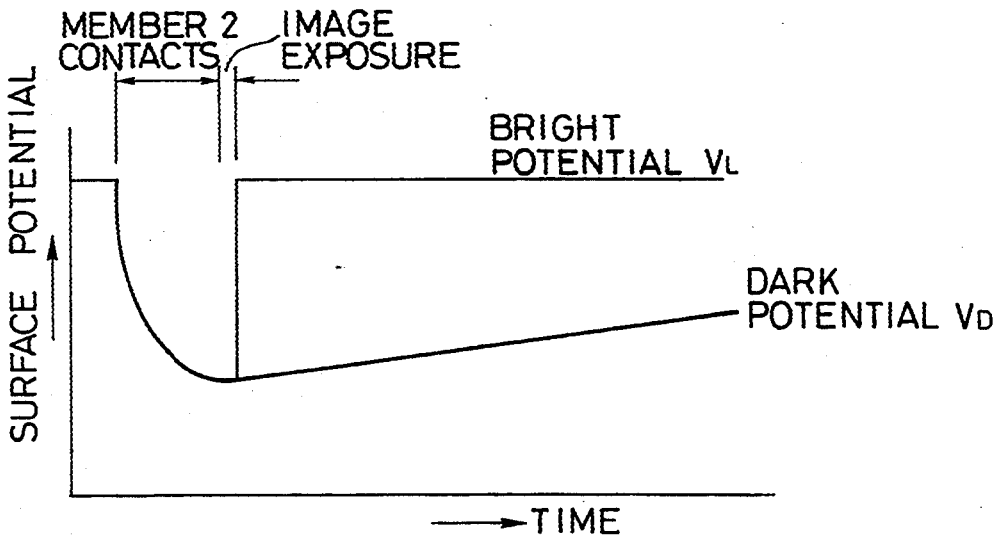
FIG. 3 is a graph showing changes in the surface potential of the sensitive medium when a positive bias voltage is applied to the sensitive medium having an N-type photoconductive layer in accordance with the present invention.

FIG. 3 schematically shows changes in the surface potential of the sensitive medium 1 in a case where a bias voltage obtained by superposing DC and AC voltages so that the voltage is shifted to the positive side is applied to the base 11 of the sensitive medium 1 having N-type photoconductive layer 12 under a dark condition. A negative charge is induced on the surface of the sensitive medium 1 in contact with the member 2 and the voltage is reduced to the divided value, as described above. The surface of the sensitive medium 1 is then exposed to a light image to be copied by an optical means such as a laser or an LED. The surface potential ($V_L$) at a position (exposed region) corresponding to a bright portion of the image thereby becomes closer to the bias voltage applied to the base 11 of the sensitive medium 1, thereby creating a potential difference from the voltage ($V_D$) at a position (non-exposed region) corresponding to a dark portion of the image. In the image forming method in accordance with the present invention, therefore, an electrostatic image is formed such that the potential corresponding to a bright image portion is higher while the potential corresponding to a dark image portion is lower, which relationship is reverse to that in the conventional method using corona discharge. In FIG. 3, the bright potential and the dark potential are indicated by straight lines for convenience. Actually, however, the surface potential of the sensitive medium 1 oscillates by superposition of the AC bias voltage applied to the base 11.

Figure 4:
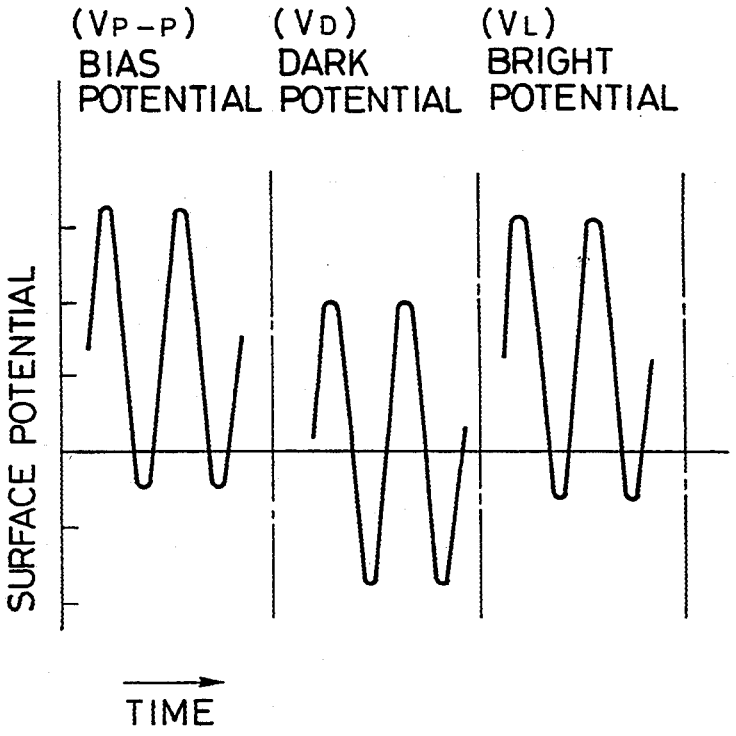
FIG. 4 is a diagram of waveforms of the surface potential of the sensitive medium.

FIG. 4 shows the dark potential and the bright potential on the surface of the sensitive medium 1 in a case where a bias voltage obtained by superposing an AC voltage of 1,500 Vp-p at a frequency of 4 kHz on a DC voltage of +400 V is applied to the base 11 of the sensitive medium 1, and where the surface of the sensitive medium 1 is irradiated with light image to form an electrostatic latent image. The waveform of the amplitude is generally equal to the waveform of the bias voltage applied to the base 11 of the sensitive medium 1, and the frequency is generally equal to that of the bias voltage.

When a negative voltage is applied to the base 11 of the sensitive medium having a P-type photoconductive layer, a positive load is induced on the surface of the sensitive medium 1, as in the above.

Referring back to FIG. 1, the electrostatic image formed on the sensitive medium is developed by a development means 3. The development means 3 includes an electroconductive sleeve 31 disposed close to the surface of the sensitive medium 1, and a magnet roller 32 disposed inside the sleeve 31 with a space G formed therebetween. The sleeve 31 and the magnet roller 32 are provided so as to be rotatable independently of each other at different speeds. In this example, the sleeve 31 and the magnet roller 32 rotate respectively in a direction (indicated by arrow B) opposite to the direction of rotation of the sensitive medium 1. These members are rotated by a drive source and a transmission means, such as a gear train, which are known per se. As is well known, a developer contained in a developer casing is attracted by the magnetic force of the magnet roller 32 to form a magnetic brush on the surface of the sleeve 31, although this magnetic brush is not illustrated. The thickness of the magnetic brush is made uniform by a doctor blade which is known per se. The developer is transported in the direction of arrow B at a speed generally equal to or slightly smaller than the peripheral speed of the sensitive medium 1, in contact with or close to the surface of the sensitive medium 1, and develops the electrostatic image to form a toner image. As the developer, a one-component magnetic toner or a two-component developer formed of a toner and a magnetic carrier.

The sleeve 31 is grounded directly or through an induced bias means 33 such as a constant-voltage diode, a high-resistance resistor or a varistor. In the example shown in FIG. 1, the sleeve 31 is grounded through induced bias means 33, and a predetermined development bias is induced on the sleeve 31 by the voltage applied to the base 11 of the sensitive medium 1. Development is effected under this development bias and the AC bias applied to the base 11. The bias voltage of the sleeve 31 depends upon the rating value of induced bias means 33 such as a constant-voltage diode or a varistor connected to the sleeve 31. For example, for a digital printer using reversal development, induced bias means 33 having a rating value such that the potential of the sleeve 31 is closer to the dark potential of the sensitive medium is selected.

The AC electric field applied to the base 11 of the sensitive medium 1 makes the developer between the sensitive medium 1 and the sleeve 31 oscillate to move reciprocatively so that the electrostatic image is clearly developed.

The toner image formed on the sensitive medium 1 is transferred onto a receptor sheet such as a paper sheet by a transfer means 4. The transfer mean 4 has a roller structure which is generally the same as that of the member 2, and includes a grounded electroconductive metallic core 41 and an electroconductive or semi-conductive layer 42 laid on the metallic core 41 and having a resistivity of $10^3$ to $10^{10}$ Ωcm. A dielectric layer 43 (FIGS. 5 and 10) may also be provided on the layer 42. The transfer means 4 is disposed in contact with or close to the sensitive medium 1, a transfer bias having a polarity opposite to that of the toner image is induced by the bias voltage applied to the base 11 of the sensitive medium 1, and the toner image on the sensitive medium is transferred onto the transfer member under this transfer bias. The transfer means 4 may alternatively have the shape of a pad or belt.

The toner remaining on the surface of the sensitive medium 1 after transfer is removed to clean the surface by a cleaning means 5, so that the sensitive medium 1 is ready for next image formation. The cleaning means 5 is formed of, for example, a cleaning brush having an electroconductive core 51 and an electroconductive brush 52 embedded in the core 51. The core 51 is grounded directly or as shown in FIG. 5, through an induced bias means 53 such as a constant-voltage diode, a varistor or the like. The residual toner on the sensitive medium 1 is thereby attracted or moved electrostatically and physically by the brush 52 to be removed from the sensitive medium 1. The toner attached to the brush 52 is removed by a scraper (not shown) disposed so as to be capable of contacting the brush 52. Instead of the brush 52, a biased cleaning roller may be used. After cleaning, the surface of the sensitive medium 1 is discharged by an eraser lamp (not shown), if necessary.

FIG. 5 shows a case where the bias voltage applied to the base 11 of the sensitive medium 1 consists of an AC voltage alone (no DC voltage is superposed). In this case, the member 2 and the transfer roller 4 are grounded through rectifier means 8 and 44, respectively. The member 2 and the transfer roller 4 are covered with dielectric layers 23 and 43, respectively. The arrangement is the same as that shown in FIG. 1 in other respects. In FIG. 5, the components identical or corresponding to those shown in FIG. 1 are indicated by the same reference characters.

Figure 6:
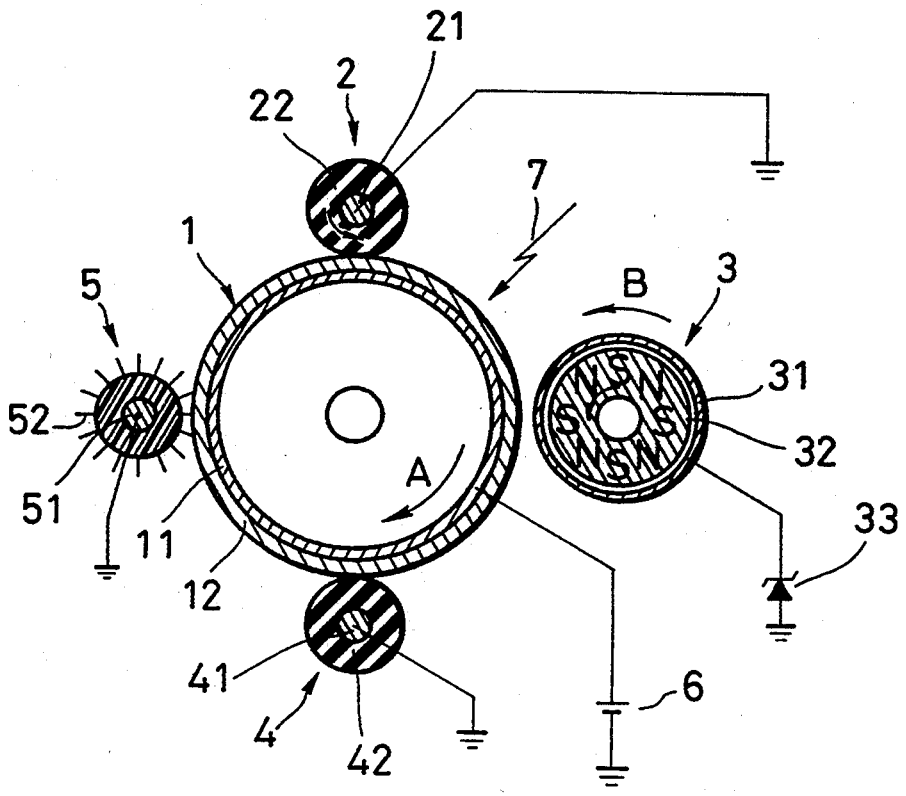
FIG. 6 is a schematic diagram of still another example of the image forming apparatus in accordance with the present invention in which a direct current voltage is applied to the electroconductive base of the sensitive medium.

FIG. 6 shows a case where the bias voltage applied to the case 11 of the sensitive medium 1 is a DC voltage. In this case, the bias voltage is set to positive polarity with respect to an N-type sensitive medium, or to negative polarity with respect to a P-type sensitive medium. The arrangement is the same as that shown in FIG. 1 in other respects, and the same components are indicated by the same reference characters.

The bias voltage applied to the base 11 of the sensitive medium 1 is, preferably, a voltage obtained by superposing an AC voltage on a DC voltage. However, using an AC or DC voltage alone as in the arrangement shown in FIG. 5 or 6 is not excluded from the scope of the present invention.

Figure 7:
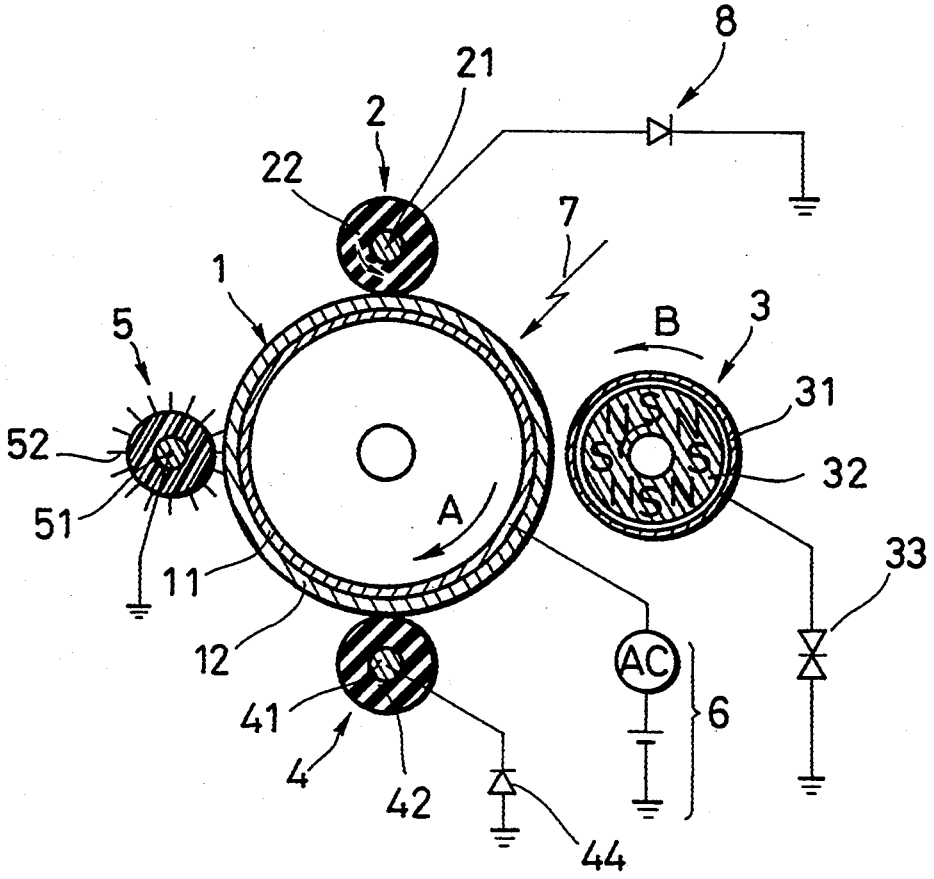
FIG. 7 is a schematic diagram of an arrangement for producing an induced bias on the transfer roller.

FIG. 7 shows another example of the transfer means 4. In this example, the core 41 is grounded through induced bias means 44 such as a diode, and the sleeve 31 of the development means 3 is grounded through a varistor 33. The member 2 is grounded through rectifier means 8. The arrangement is the same as that shown in FIG. 1 in other respects.

The transfer means 4 transfers the toner image by a transfer bias induced by the diode 44. The direction of connection of the diode 44 is determined by the kind of development. For example, transfer in the case of reversal development using an N-type sensitive medium is as described below. A voltage is applied to the base 11 of the sensitive medium 1 by superposing an alternating current on a direct current biased to positive polarity, and the member 2 is grounded through a diode 8, a cathode of the diode 8 being connected to ground. The potential of the electrostatic image formed on the sensitive medium 1 is positive. In this case the electrostatic image is developed by a toner of negative polarity. The transfer means 4 is therefore arranged to produce a positive transfer bias. The diode 44 is grounded by being connected at its anode to ground. A positive half-wave voltage is induced on the transfer means 4, and the toner image is transferred under this transfer bias. The arrangement is substantially the same in a case where only an AC bias is applied to the base 11 of the sensitive medium 1.

Figure 8:
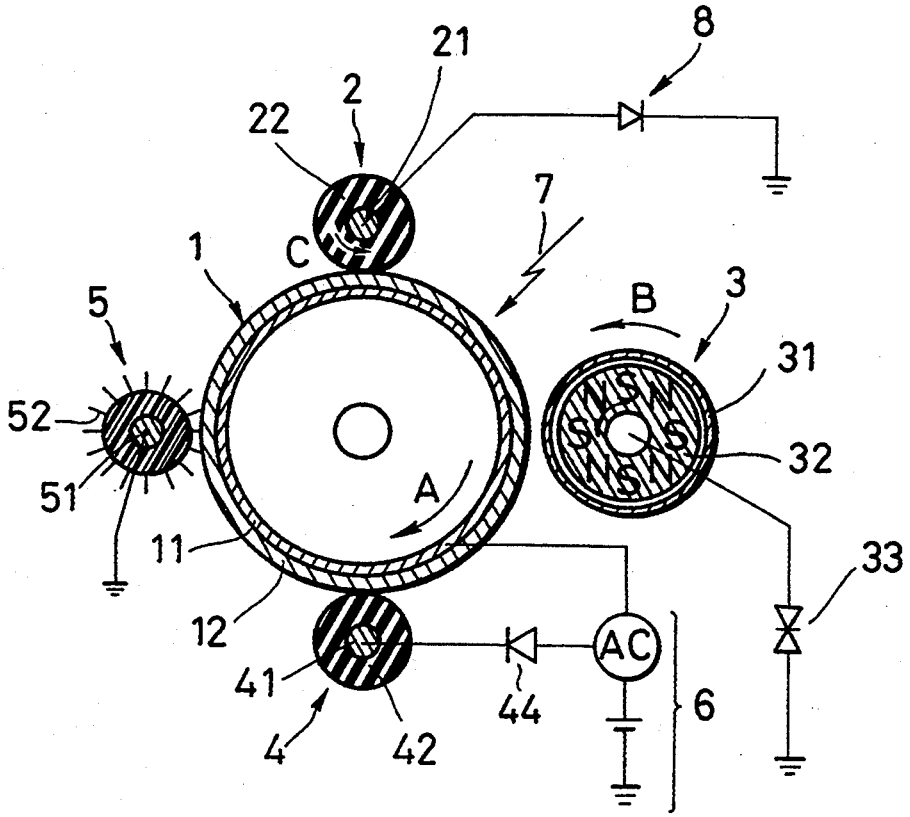
FIG. 8 is a schematic diagram of an arrangement in which the bias supply for the sensitive medium also serves as a bias supply for the transfer roller.

FIGS. 8 and 10 show examples of an arrangement in which the transfer means 4 is connected to the bias supply 6. Components identical or corresponding to those shown in FIG. 1 or 5 are indicated by the same reference characters.

Referring to FIG. 8, a voltage obtained by superposing an alternating current on a direct current is applied to the base 11 of the sensitive medium 1 by the bias supply 6. The core 41 of the transfer means 4 is connected to an output terminal of the bias supply 6, and a voltage of an alternating current or a current obtained by superposing a direct current on an alternating current which voltage is generally in phase with the bias voltage applied to the base 11 of the sensitive medium 1 is applied to the core 41. In several experiments, occurrence of blur in a copied image due to an increase in the voltage between the transfer means 4 and the sensitive medium 1 was observed in a case where only a DC voltage was applied to the core 41. With respect to the case of applying only an alternating current to the core 41, as well, occurrence of blur in a copied image or damage to the image was observed When there was a phase difference between the alternating current applied to the core 41 and the alternating current applied to the sensitive medium 1. In contrast, no blur was recognized in the case of the above arrangements.

Figure 9:
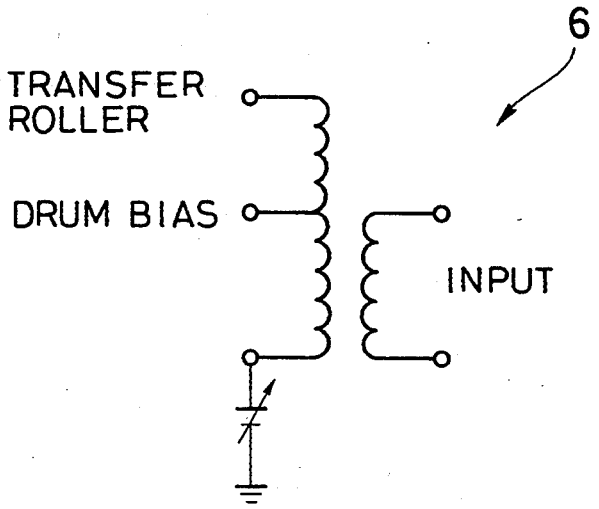
FIG. 9 is a diagram of an example of the bias supply shown in FIG. 8.

FIG. 9 shows an example of the bias supply 6 of the arrangement shown in FIG. 8. A tap of a different output level is provided on the output coil of the bias supply 6 to apply a transfer bias to the transfer means in accordance with a predetermined condition for the image formation process. As mentioned above, this voltage has an amplitude generally in phase with the bias voltage applied to the base 11 of the sensitive medium 1.

Referring then to FIG. 10, the bias voltage to the base 11 of the sensitive medium 1 has an AC component alone, and the core 41 of the transfer means 14 is connected to an output terminal of the bias supply 6 through diode 44. In this example, the bias supply 6 has an AC component alone but a DC component may also be superposed thereon.

EXPERIMENTAL EXAMPLE 1

In an apparatus arranged as shown in FIG. 1, a voltage obtained by superposing a DC voltage of +1,100 V on an AC voltage of 1,500 Vp-p at a frequency of 2 kHz was applied to base 11 of sensitive medium 1 having N-type organic photoconductive layer 12, and sensitive medium 1 was rotated in the direction of arrow A at a peripheral speed of 40 mm/sec. Member 2 having grounded core 21 and elastic layer 22 formed of NBR, urethane or a silicone rubber and an electroconductive powder mixed in, the rubber was brought into contact with the surface of sensitive medium 1 under a dark condition, and the sensitive medium surface was irradiated with laser light 7 to form an electrostatic image. At this time the surface potential of the sensitive medium was measured. The dark potential of the electrostatic image was +280 V while the bright potential was +1,050 V. Then the electrostatic image was developed by a one-component magnetic toner of positive polarity and by using development sleeve 31 grounded through a constant-voltage diode having a rating of 760 V. As development sleeve 31, a sleeve having an outside diameter of 18 mm, formed of SUS 304 and having its surface processed by shotblast of about 400 mesh was used. Magnetic roller 32 having six magnetic poles S and N alternately disposed was rotated in development sleeve 31 so that an alternating magnetic field of about 600 gauss at the surface of sleeve 31 was applied to the toner. The distance between sensitive medium 1 and development sleeve 31 was 0.3 mm. The toner on development sleeve 31 is brought into contact with the surface of sensitive medium 1 to effect development. The toner image thereby developed was transferred onto a transfer sheet by transfer means 4 and was fixed, thereby obtaining a clear copied image free from fog.

EXPERIMENTAL EXAMPLE 2

Experiment was made in such a manner that the frequency of the AC component of the bias voltage applied to base 11 of sensitive medium 1 was changed in the range of 80 to 30 kHz, and that other conditions were the same as those for Example 1. A clear copied image was thereby formed.

EXPERIMENTAL EXAMPLE 3

Experiment was made in such a manner that only an AC voltage was used as the bias voltage applied to base 11 of sensitive medium 1, member 2 and the transfer roller 4 were grounded through rectifier means 8 and 44, respectively, and other conditions were the same as those for Example 1. A clear copied image was thereby formed.

EXPERIMENTAL EXAMPLE 4

Development was effected by using a two-component developer formed of a mixture of a magnetic toner and 5 to 45% by weight of a carrier was used under the same conditions as Example 1. A clear image was thereby obtained. 25 to 65% by weight of a ferrite powder was contained in the magnetic toner used.

EXPERIMENTAL EXAMPLE 5

In an apparatus arranged as Shown in FIG. 6, a DC voltage of +1,100 V was applied to base 11 of sensitive medium 1 having N-type organic photoconductive layer 12, and sensitive medium 1 was rotated in the direction of arrow A at a peripheral speed of 40 mm/sec. Member 2 having grounded core 21 and elastic layer 22 formed of NBR, urethane or a silicone rubber and an electroconductive powder mixed in the rubber was brought into contact with sensitive medium 1 under a dark condition, and the sensitive medium was irradiated with laser light 7 to form an electrostatic image. At this time,the surface potential of the sensitive medium was measured. The dark potential of the light image was +550 V while the bright potential was +1,050 V. Next, the electrostatic image was developed by contact with a one-component magnetic toner of positive polarity and by using development sleeve 31 grounded through a constant-voltage diode of 760 V. A clear copied image was thereby obtained.

EXPERIMENTAL EXAMPLE 6

In an apparatus arranged as shown in FIG. 6, a DC voltage of −1,100 V was applied to base 11 of sensitive medium 1 having P-type organic photoconductive layer 12, and an electrostatic image was formed in substantially the same manner as Example 5 and was developed by a one-component magnetic toner of negative polarity. A clear copied image was thereby obtained.

EXPERIMENTAL EXAMPLE 7

Experiment was made by using the two-component developer used in Example 4 while other conditions were the same as those for Example 5. A clear copied image was thereby obtained.

EXPERIMENTAL EXAMPLE 8

Experiment was made by using the two-component developer used in Example 4 (but toner polarity is negative) while other conditions were the same as those for Example 6. A clear copied image was thereby obtained.

EXPERIMENTAL EXAMPLE 9

In an apparatus arranged as shown in FIG. 7, a voltage obtained by superposing an AC voltage of 1,500 Vp-p (at a frequency of 80 Hz to 30 kHz) on a DC voltage of +400 V was applied to base 11 of sensitive medium 1 having N-type organic photoconductive layer 12, and sensitive medium 1 was rotated in the direction of arrow A at a peripheral speed of 40 mm/sec. Member 2 having elastic layer 22 formed of NBR or a silicone rubber and an electroconductive powder mixed in the rubber was brought into contact with sensitive medium 1 under a dark condition, and the sensitive medium was irradiated with laser light 7 to form an electrostatic image. This image was developed by reversal development.

For the development, a two-component developer having a resistivity of about $10^7$ to $10^9$ Ωcm and formed of a mixture of 100% by weight of a spherical ferrite carrier having an average particle size of 50 μm and 5% by weight of a toner containing an acrylic resin as a main component was used. As development sleeve 31, a sleeve having an outside diameter of 18 mm, formed of SUS 304 and having its surface processed by shotblast of about 400 mesh was used and was connected to a DC bias supply. Magnetic roller 32 having six magnetic poles S and N alternately disposed was rotated in development sleeve 31 so that an alternating magnetic field of about 600 gauss at the surface of sleeve 31 was applied to the toner. The distance between sensitive medium 1 and development sleeve 31 was 0.3 mm. The toner on development sleeve 31 is brought into contact with the surface of sensitive medium 1 to effect development. The developed image was transferred onto a transfer sheet by transfer means 4 grounded through diode 44, thereby obtaining a clear image free from background contamination.

The similar result was obtained in case of grounding the development sleeve through a varistor.

EXPERIMENTAL EXAMPLE 10

Experiment was made by using a one-component magnetic toner having an average particle size of 12 μm and a resistivity of $10^{14}$ to $10^{15}$ Ωcm while other conditions were the same as those for Example 9. A clear image free from background contamination was thereby obtained.

EXPERIMENTAL EXAMPLE 11

Experiment was made in such a manner that 6 g of a spherical ferrite powder of 35 to 60 μm was previously attached uniformly to the development sleeve surface as a developer carrier, the toner had an average particle size of 12 μm and a resistivity of $10^{14}$ to $10^{15}$ Ωcm, and other conditions were the same as those for Example 9. A clear image free from background contamination was thereby obtained.

EXPERIMENTAL EXAMPLE 12

In an apparatus arranged as shown in FIG. 8, a toner image was formed under the same conditions as Example 9. The toner image was transferred by transfer roller 4 connected power supply 6 as shown in FIG. 9. A clear image free from background contamination was thereby obtained.

EXPERIMENTAL EXAMPLE 13

Experiment was made by using a one-component magnetic toner having an average particle size of 12 μm and a resistivity of $10^{14}$ to $10^{15}$ Ωcm while other conditions were the same as those for Example 12. A clear image free from background contamination was thereby obtained.

EXPERIMENTAL EXAMPLE 14

Experiment was made in such a manner that 6 g of a spherical ferrite powder of 35 to 60 μm was previously attached uniformly to the surface of development sleeve 31 as a developer carrier, the toner had an average particle size of 12 μm and a resistivity of $10^{14}$ to $10^{15}$ Ωcm, and other conditions were the same as those for Example 12. A clear image free from background contamination was thereby obtained.

According to the present invention, as described above, a means for applying a bias voltage to the base 11 of the sensitive medium 1 is used and the ! need for charging means and expensive high-voltage power sources for the development sleeve, the transfer roller and so on is eliminated, thereby making it possible to provide a simple and low-cost image forming apparatus.

An alternating current or an alternating current on which a DC current is superposed is used, whereby a clear image free from fog, in particular, can be obtained. It is also possible to induce charge for the cleaning brush in the same manner without providing any additional power source. The apparatus can thereby be simplified.

In the embodiments shown in FIGS. 8 and 10, the voltage applied to the transfer roller and the voltage applied to the sensitive medium are generally in phase with each other. It is thereby possible to prevent occurrence of an abnormal voltage between the sensitive medium and the transfer roller and, hence, to form an image free from blur.

What is claimed is:

1. An image forming method comprising the steps of:

applying an alternating current voltage or a voltage obtained by superposing a direct current voltage on an alternating current voltage to an electroconductive base of a sensitive medium having a photoconductive layer formed on the electroconductive base;

bringing a grounded electroconductive or semi-electroconductive member into contact with or close to a surface of the sensitive medium to charge the same to a predetermined polarity; and exposing the surface of the sensitive medium to an image to form an electrostatic image.

2. An image forming method according to claim 1, wherein the electrostatic image is developed by bringing a toner into contact with or close to the surface of the sensitive medium with a developer supplier grounded directly or through induced bias means.

3. An image forming method according to claim 2, wherein the electroconductive or semi-electroconductive member is grounded through a rectifier means or induced bias means.

4. An image forming method according to claim 2, wherein the electroconductive or semi-electroconductive member has a dielectric layer formed on its outer surface.

5. An image forming method according to claim 1, wherein the electroconductive or semi-electroconductive member is grounded through a rectifier means or induced bias means.

6. An image forming method according to claim 1, wherein the electroconductive or semi-electroconductive member has a dielectric layer formed on its outer surface.

7. An image forming method according to claim 1, wherein an electroconductive or semi-electroconductive transfer member is disposed in contact with or close to the surface of the sensitive medium and is grounded directly or through induced bias means so that a voltage having a polarity opposite to that of a toner image is induced on the transfer member to transfer the toner image.

8. An image forming method according to claim 7, wherein a surface of the transfer member is covered with a dielectric layer.

9. An image forming method according to claim 1, wherein transfer is effected by applying, to a transfer member disposed in contact with or close to the sensitive medium, an alternating current voltage or a voltage obtained by superposing a direct current voltage on an alternating current voltage generally in phase with the bias voltage applied to the base of the sensitive medium.

10. An image forming method according to claim 9, wherein an intermediate tap is provided in an output winding of a power supply unit for applying the bias voltage to the electroconductive base of the sensitive medium, an output from the intermediate tap being applied to the transfer member.

11. An image forming method according to claim 10, wherein the output from the power supply unit for applying the bias voltage to the electroconductive base of the sensitive medium is applied to the transfer member through a diode.

12. An image forming apparatus comprising:

a sensitive drum having at least an electroconductive base and a photoconductive layer;

means for applying an alternating current voltage or a voltage obtained by superposing a direct current voltage on an alternating current voltage to the electroconductive base of said sensitive drum;

an electroconductive or semi-electroconductive member disposed into contact with or close to a surface of said sensitive drum and grounded;

means for exposing the surface of said sensitive drum to an image; and a developer supplier disposed close to the surface of said sensitive drum and grounded directly or through induced bias means.

13. An image forming apparatus according to claim 12, wherein said induced bias means includes a diode, constant-voltage diode, varistor or a high-resistance resistor.

14. An image forming apparatus according to claim 12, wherein said member comprises a rotating roller.

15. An image forming apparatus according to claim 12, further comprising a transfer member grounded directly or through an induced bias means.

16. An image forming apparatus according to claim 15, wherein the transfer member induced bias means includes a diode, constant-voltage diode, varistor or a high-resistance resistor.

17. An image forming apparatus according to claim 12, wherein said member is grounded through rectifier means or induced bias means.

18. An image forming apparatus according to claim 17, further comprising an electroconductive cleaning member grounded directly or through an induced bias means.

19. An image forming apparatus according to claim 18, wherein the electroconductive cleaning member induced bias means includes a diode, constant-voltage diode, varistor or a high-resistance resistor.

20. An image forming apparatus according to claim 12, further comprising an electroconductive cleaning member grounded directly or through an induced bias means.

21. An image forming apparatus according to claim 20, wherein the electroconductive cleaning member induced bias means includes a diode, constant-voltage diode, varistor or a high-resistance resistor.

22. An image forming method comprising the steps of:

applying a direct current voltage to an electro-conductive base of a sensitive medium;

bringing a grounded electroconductive or semi-electroconductive member into contact with, or close to a surface of the sensitive medium to charge the same to a predetermined polarity;

exposing the surface of the sensitive medium to an image to form an electrostatic image; and developing the image by bringing a toner into contact with, or close to the surface of the sensitive medium with a developer supplier grounded directly or through induced bias means.

23. The image forming method according to claim 22, wherein a positive direct current is applied to the electroconductive base if the sensitive medium is formed of an N-type semiconductor, and a negative direct current is applied to the electroconductive base if the sensitive medium is formed of a P-type semiconductor.

* * * * *